United States Patent [19]

Kagawa

[11] 4,207,629

[45] Jun. 17, 1980

[54] TUB-BATHING EQUIPMENT FOR BEDRIDDEN OLD PEOPLE AND PHYSICALLY-HANDICAPPED PEOPLE

[76] Inventor: Hideo Kagawa, No. 11-17-604, Otemachi, 2-chome, Hiroshima-shi, Japan

[21] Appl. No.: 954,412

[22] Filed: Oct. 25, 1978

[30] Foreign Application Priority Data

Nov. 2, 1977 [JP] Japan ..... 52/131684

[51] Int. Cl.[2] ..... A47K 3/08

[52] U.S. Cl. ..... 4/540; 4/546; 4/579

[58] Field of Search ..... 4/176, 173, 177 R, 175, 4/185 L, 188, 185 S

[56] References Cited

U.S. PATENT DOCUMENTS

| | | | |
|---|---|---|---|
| 1,943,888 | 1/1934 | Ewald | 4/176 |
| 2,514,848 | 7/1950 | Davis | 4/176 |
| 2,536,540 | 1/1951 | Davis | 4/176 |
| 3,174,160 | 3/1965 | Fielding | 4/176 |

*Primary Examiner*—Henry K. Artis

[57] ABSTRACT

A tub-bathing equipment for bedridden old people, physically-handicapped people and so on, in which a bathtub fitted into a rectangular frame of a carriage from above is slanted by a crane disposed under the bathtub so that the side of the shallowest portion of the bathtub is lowered to the floor to allow ease in helping the patient into or out of the bathtub.

1 Claim, 8 Drawing Figures

TUB-BATHING EQUIPMENT FOR BEDRIDDEN OLD PEOPLE AND PHYSICALLY-HANDICAPPED PEOPLE

BACKGROUND OF THE INVENTION

This invention relates to a tub-bathing equipment for bedridden old people and physically-handicapped people.

Bedridden old people and physically-handicapped people (hereinafter collectively referred to the physically-handicapped person or patient) commonly have much trouble in bathing in a tub, as it causes cares to more than a nurse, supporting the patient's body, another his shoulders, still another taking his hands, etc. after undressing the patient. That is why such a measure as wiping the patient with a steamed towel is used nowadays instead of giving him a tub bath. As the physically-handicapped person generally has much bodily secretion, as compared with healthy persons, resulting in its adhesion and accumulation on his body, it can be hardly expected that his body can be thoroughly cleared of such filth and dusts only by wiping it with a steamed towel. That is why the tub bathing is preferred to steamed towel treatment in keeping the body of the patient thoroughly clean. Beside, as aforesaid, tub-bathing causing much trouble to the nursing hands, however, it gives much physical and mental pain to the patient.

SUMMARY OF THE INVENTION

This invention is to provide a tub-bathing equipment which offers one of resolutions of such problems inherent with tub-bathing by relieving much of trouble in taking care of the patient, not only reducing the patient's pain but also enabling him to enjoy bathing.

DESCRIPTION OF THE PREFERRED EMBODIMENT

With reference to the drawings, this invention will hereinafter be described in detail.

Figure 1:
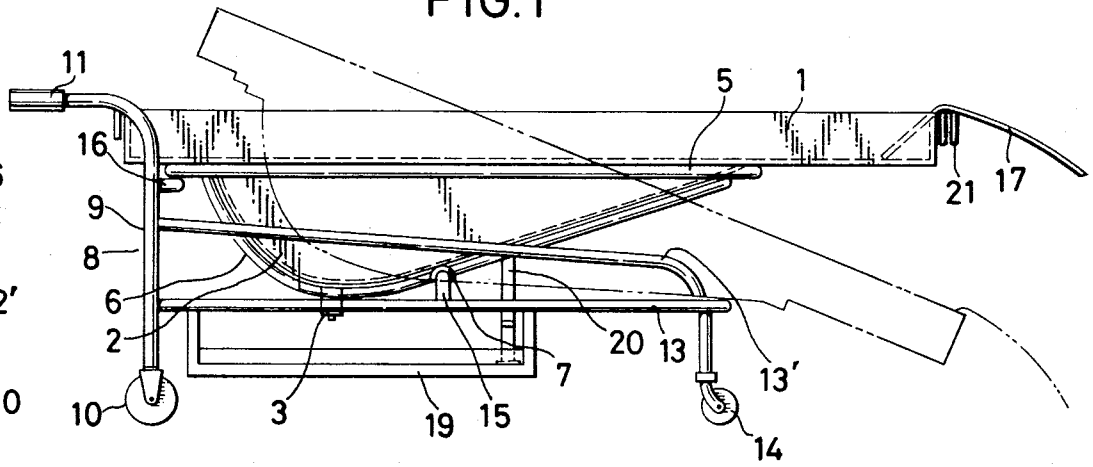
FIG. 1 is a sectional view showing an embodiment of this invention.

Referring to FIG. 1, a tub-bathing equipment indicated generally by 1 is provided with a bathtub 2 installed on a carriage 8 in its lengthwise direction to hang down, which tub is shaped like a shallot longistudinally cut into halves as seen in its sectional view; and in order that the patient can take a comfortable posture in the tub 2 when put down therein, the portion which is receptive of the patient's hips is formed deep and the tub from that portion becomes increasingly shallow as it runs toward the portion to lay the patient's legs. In the depth of the tub 2 there is provided a drain cock 3. The edge of the tub 2 protrudes out all around to a suitable length, forming an angle bracket portion 4 whose end is bent down vertically.

Figure 4:
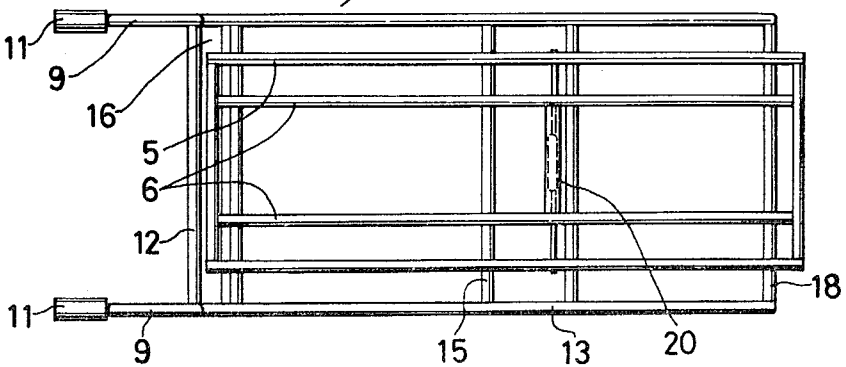
FIG. 4 is a top plan view of a carriage removed of a bathtub.
Figure 2:
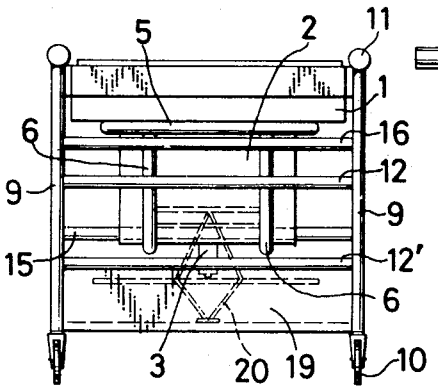
FIG. 2 is a left side view of the embodiment of FIG. 1.
Figure 3:
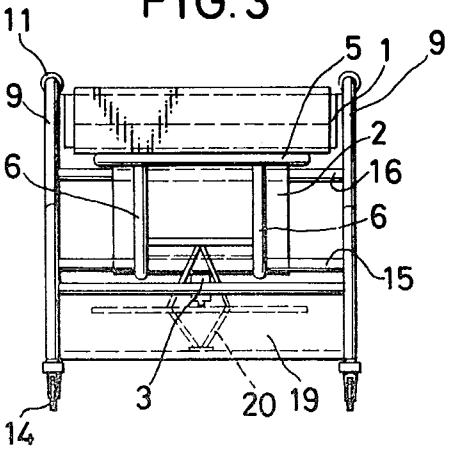
FIG. 3 is a right side view of the embodiment of FIG. 1.
Figure 6:
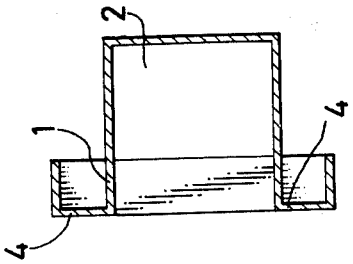
FIG. 6 is a cross-sectional view taken on the line A—A in FIG. 5.
Figure 5:
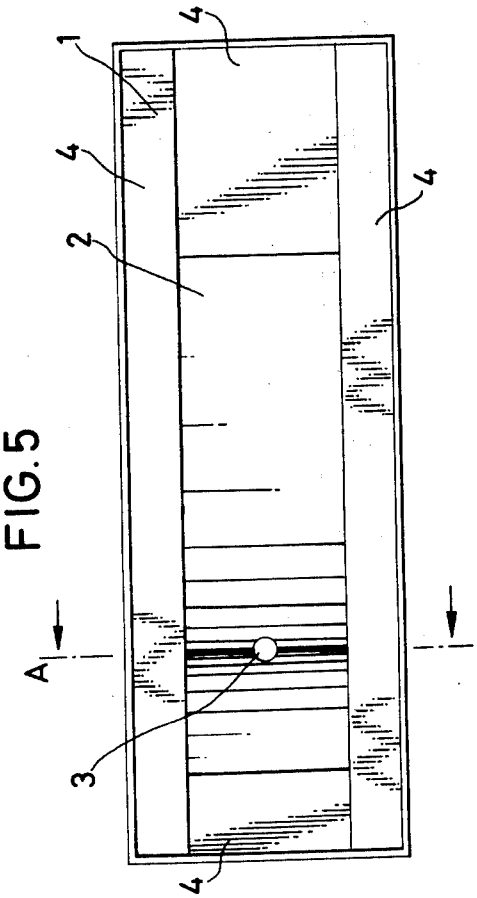
FIG. 5 is top plan view of the bathtub.
Figure 8:
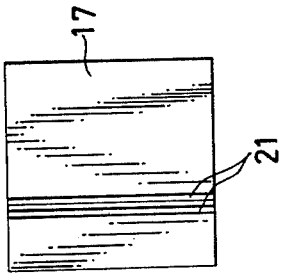
FIG. 8 is a bottom view of the foot step shown in FIG. 7.
Figure 7:
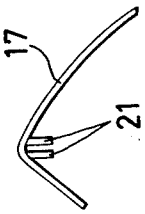
FIG. 7 is a side view of a foot step.

To install the tub 2 on the carriage 8, a rectangular frame 5, as shown in FIG. 4, is so formed as to fit therein the tub 2 with its angle bracket portion 4 resting on the frame 5; and two or three tub supports 6, extending along the curved bottom of the tub 2 in its lengthwise direction as shown, are welded at both ends of both shorter sides of the frame 5, so that the tub 2 can be supported from under, thus whereby it can now receive the patient into the tub 2 while in the case of suitably hot water being poured thereinto it serves to reinforce the tub 2. By resting the angle bracket portion 4 of the tub 2 on the frame 5, and then after locating the position where it is possible to eightly operate the tub 2 up and down, a semicylindrical member 7 having a C-shaped cross section is, in the manner of making that position a pivot, welded thereto the tub supports 6 in parallel with the shorter side of the frame 5, with its opening face down.

The carriage 8 that supports the rectangular frame 5 has one of the ends of each of its handle rods 9 attached to a wheel 10 that has a wire brake (not shown) mounted thereto. Curved, the other ends each have a handle 11 and are set up facing outwardly at the position where they lightly hold the tub 2 therebetween; then the near-central portion of the handle rod 9 and its lower portion are respectively linked with the handle rod 9 on both sides by means of coupling rods 12 and 12'. On the other hand, support rods 13 nearly as long as the longer side of the rectangular frame 5 and extending horizontally from the positions of both ends of the coupling rod 12' at right angles thereto are each welded at one end to the handle rod 9, while the other ends each have a universally rotatable small wheel 14 vertically attached thereto. And, across the position of the coupling rod 12 to the tip end of each support rod 13, there is a support rod 13' with its end, somewhat sloping, being bent down, to be welded to each handle rod 9 at the position of the coupling rod 12 and the tip of the support rod 13; and then, a support rod 15 is welded, across the frame 5, to the middle part of each support rod 13 at the position where it can support the sectional C-shaped opening of the semicylindrical member 7 welded to the tub support 6, with the C-shaped opening engaged with the support rod 15, and at the same time, a retaining plate 16 for receiving the rectangular frame 5 from under is, at the position where the rectangular frame 5 is held horizontal, welded to the both handle rods 9 to extend therebetween. Next, the tub 2 is fitted into the rectangular frame 5, placing the depth portion of the tub on the handle rod side, with the foot step 17 provided on the opposite side from the handle rod side. The tub 2 is raised from the handle rod side; and at the position where the end of the foot step 17 can touch the floor, a retaining rod 18 is inserted between the support rods 13 and the rectangular frame 5 and welded at both ends to the support rods 13 of both sides.

A container 19 having an opening is disposed between the both support rods 13 and welded thereto, to house a crane 20 in the position where it is suitable to extend and contract the crane 20 in the most limited space for holding the tub 2 horizontally and inclining it toward the foot step side and to support the tub 2 stably from under. The top end portion of the crane 20 is detachably attached to the tub supports 6 of the rectangular frame 5.

In order to help the patient into or out of the bathtub 2 with ease and insure safety for him, the foot step 17 of an L-shaped cross section, which has a plate 21 of an inverted U-shaped cross section welded to the underside of the top portion of the foot step 17, is detachably mounted on the tub edge on the side of the portion for the patient's legs, with the U-shaped plate 21 having fitted thereinto the tub edge.

And, to the drain cock 3 and the crane 20 are attached their operating handles.

The above is the construction of this invention.

Now, an example of the use of the tub-bathing equipment of the instant invention will be described in detail.

On the rectangular frame 5 equipped on the carriage 8 is the tub 2 suspended down from above; with the angle bracket portion 4 fixedly rested on the rectangular frame 5, and the foot step 17 is put up against the edge of the tub 2 on the side of its portion for the patient's legs. Then, the tub-bathing equipment is carried by manipulating the handle rods 9 to the position where the patient is laid, and the tub 2 is inclined forwardly by manipulating the crane 20 to make the end of the foot step 17 contact the floor, whereupon the carriage 8 is fixed by clamping the wire brakes. Next, guidance is given the patient by supporting his shoulders or taking his hands to cross over the foot step 17 into the tub 2. If on this occasion the patient is in his pyjamas, they are taken off in the tub 2. After the portion for the patient's legs is raised by operating the crane 20 to make the tub 2 horizontal, the edge of the rectangular frame 5 hits the retaining plate 16; whereupon a crane driving device is stopped, and hot water is filled into the tub 2 so as to bathe the body of the patient. When bathing is finished, a rubber hose is connected to the drain cock and the drain cock is opened, and after the drainage, the rubber hose is tuck away into the container 19. The patient is, after drying his body, dressed again, or otherwise transported to his bed, where the portion for the patient's legs of the tub 2 is lowered by operating the crane 20, and the carriage 8 is fixed by a wire rope, whereupon the patient is helped out of the tub 2 into his bed.

As revealed by the above description, the present invention has such advantages as follows:

This invention:

(1) Enables the patient to take a comfortable bath, without any bodily or mental strain, as well as it can dispense with so many nurses as needed today in bathing the physically-handicapped persons.

(2) Provides convenience in bathing such persons in addition to the easiness of draining foul water from and filling fresh hot water into the tub only by the manipulation of the drain cock; and economizes water consumption as such means of water replacement consumes a much less amount of water than by ordinary means of bathing;

(3) Saves much of the nursing labor since the patient can be transported by means of the carriage 8;

(4) Enables the container 19 to house such components as a drain cock 3, and foot step 17, so that the carriage does not require the space nor equipment to keep them; and since the tub is easily detachable from the carriage, it can be thoroughly cleaned everytime it is used, so that it enables its users at all times to enjoy a clean, sanitary water bath, and economically;

(5) Makes it possible for the bath tank to move up and down lightly, as well as manually operable, so that, if the retaining plate and the rectangular frame 5 are made unoperable during bathing by screw means from under, the installation of the crane 20 could be saved.

What is claimed is:

1. A tub-bathing equipment for bedridden old people, physically-handicapped people and so on, comprising:

a bathtub shaped, in its longitudinal section, like a shallot longitudinally cut into halves and equipped with angle bracket portions on four sides of the top surface, a drain cock at the deepest portion of the tub bottom and a foot step detachably mounted on the tub on the side of its portion for the bather's legs to lay;

a carriage having a rectangular frame for receiving the bathtub inserted thereinto from above, with its angle bracket portions engaged with the rectangular frame, a pair of handle rods, each equipped at one end with a wheel, a pair of support rods, each extending from one of the handle rods in the lengthwise direction of the carriage and equipped at one end a wheel, and another support rod fixed at both ends to the support rods to extend across the carriage, the rectangular frame having tub supports for supporting the curved bottom portion of the bathtub, the tub supports having mounted thereon a semicylindrical member across their undersides, with its opening facing down and the opening of the semicylindrical member being engaged with said another support rod; and a crane installed in a container disposed at the lower portion of the carriage;

wherein the bathtub supported by the rectangular frame is carried by the carriage, with the deepest portion of the bathtub placed on the side of the handle rods of the carriage; and wherein the top end of the crane is detachably mounted to the tub support in the manner that it enables the bathtub to move up and down.

* * * * *